US009055825B2

(12) United States Patent
Sadaoka

(10) Patent No.: US 9,055,825 B2
(45) Date of Patent: Jun. 16, 2015

(54) INFLATABLE MANNEQUIN AND METHOD OF MANUFACTURING THE SAME

(75) Inventor: Soichiro Sadaoka, Chiba (JP)

(73) Assignee: MIND CREATE JAPAN, INC., Tokyo (JP)

( * ) Notice: Subject to any disclaimer, the term of this patent is extended or adjusted under 35 U.S.C. 154(b) by 202 days.

(21) Appl. No.: 12/740,156

(22) PCT Filed: Oct. 30, 2008

(86) PCT No.: PCT/JP2008/003104

§ 371 (c)(1),
(2), (4) Date: Sep. 1, 2010

(87) PCT Pub. No.: WO2009/057305

PCT Pub. Date: May 7, 2009

(65) Prior Publication Data

US 2010/0320240 A1 Dec. 23, 2010

(30) Foreign Application Priority Data

Nov. 2, 2007 (JP) ..... 2007-285975

(51) Int. Cl.
*A41B 5/00* (2006.01)
*A47F 8/00* (2006.01)

(52) U.S. Cl.
CPC ..... *A47F 8/00* (2013.01); *Y10T 29/49826* (2015.01)

(58) Field of Classification Search
USPC ..... 223/66–368
See application file for complete search history.

(56) References Cited

U.S. PATENT DOCUMENTS

| | | | | | |
|---|---|---|---|---|---|
| 1,447,372 | A * | 3/1923 | Bailey | 223/68 |
| 1,479,443 | A * | 1/1924 | Bailey | 223/68 |
| 2,605,029 | A * | 7/1952 | Cella | 223/68 |
| 3,472,434 | A * | 10/1969 | Cherry et al. | 223/67 |
| 3,710,994 | A * | 1/1973 | Cherry et al. | 223/67 |
| 3,826,170 | A * | 7/1974 | Jones et al. | 83/657 |
| 5,692,326 | A * | 12/1997 | Mohan et al. | 38/7 |
| 6,840,412 | B2 * | 1/2005 | Damrath et al. | 223/57 |
| 7,886,944 | B2 * | 2/2011 | Damrath et al. | 223/70 |
| 2006/0261101 | A1 * | 11/2006 | Damrath et al. | 223/66 |

FOREIGN PATENT DOCUMENTS

| | | | |
|---|---|---|---|
| CN | 2462788 | Y | 12/2001 |
| CN | 2798744 | Y | 7/2006 |
| JP | 3621337 | Y1 | 8/1961 |
| JP | 4630752 | Y1 | 10/1971 |
| JP | 5016211 | B2 | 6/1975 |

* cited by examiner

*Primary Examiner* — Shaun R Hurley
*Assistant Examiner* — Andrew W Sutton
(74) *Attorney, Agent, or Firm* — Porzio, Bromberg & Newman, P.C.

(57) ABSTRACT

A plurality of sheets made of an elastic material such as vinyl and polypropylene are joined together by high-frequency gluing to form an airtight bag body. Then, the bag body is inflated by being filled with air to form a mannequin resembling the shapes of the upper and lower halves of a body. Regarding an upper bag body portion resembling the upper half of the body and a lower bag body portion resembling the lower half thereof, gussets are coupled through curved junction lines with sheets that form the respective base parts. A joining jig is used to join the sheets, thereby forming an airtight bag body. The foregoing provides an inflatable mannequin and a method of manufacturing the same that can express a natural and realistic body shape and that never damage the brand image of clothes a person who sees the mannequin wearing the clothes has.

8 Claims, 15 Drawing Sheets

INFLATABLE MANNEQUIN AND METHOD OF MANUFACTURING THE SAME

CROSS REFERENCE TO RELATED APPLICATION

This is a National Stage of International Application No. PCT/JP2008/003104, filed Oct. 30, 2008, which claims the benefit of Application No. 2007-285975, filed in Japan on Nov. 2, 2007, the disclosures of which Applications are incorporated by reference herein.

TECHNICAL FIELD

The present invention relates to an inflatable mannequin (air mannequin) used in stores in which clothes are sold or display rooms, and a method of manufacturing the same.

BACKGROUND ART

Japanese Patent Application Laid-Open No. 2003-319857 (hereinafter, referred to as Patent Document 1) discloses a technique relating to a conventional inflatable mannequin. When transported and stored, the inflatable mannequin disclosed in Patent Document 1 is evacuated to let the internal air out for the convenience in transportation and handling, and is inflated by being filled with air when displayed. However, the mannequin disclosed in Patent Document 1 was not technically devised to have a chest shape that is an issue unique to a women's mannequin, more specifically, to have a natural and aesthetically pleasing body outline at right and left breasts and their surrounding parts.

A known example of the women's mannequin is shown in FIG. 15. More specifically, formation of this women's mannequin includes cutting a soft thermosetting resin material sheet into predetermined parts and joining the cut sheets by high-frequency gluing or heat welding, thereby integrally forming the upper and lower halves of a body. This mannequin is inflated by being filled with air through an air valve, so that a resultant shape of the mannequin has a predetermined women's body shape. The mannequin is outfitted with clothes, ornaments and others, and is then used in a display room.

Japanese Patent Application Laid-Open No. 2002-346292 (hereinafter, referred to as Patent Document 2) discloses an inflatable mannequin. Japanese Patent Application Laid-Open No. 2000-342859 (hereinafter, referred to as Patent Document 3) discloses an inflatable dummy article. However, the shape of each of the mannequin and the dummy article is defined by merely filling a bag body with air for inflation.

DISCLOSURE OF INVENTION

Problem to be Solved by Invention

The above-described women's mannequin is formed by merely welding cut sheets. This results in small amount of inflation at mammary regions and their neighboring regions as shown in dotted lines in FIG. 15. Besides, welding process necessarily causes breasts, more specifically right and left nipples to expand outward in a direction in which they are away from each other. This makes it difficult to express a realistic and natural body shape around breasts unique to women. So, the above-described mannequin makes it hard to obtain proper evaluation of marketability of clothes.

The present invention has been made to overcome the foregoing problems. It is an object of the invention to provide an inflatable mannequin and a method of manufacturing the same that can express a natural and realistic body shape and that never damage the brand image of clothes a person who sees the mannequin wearing the clothes has.

Means for Solving Problem

In order to achieve the above object, the present invention employs the following configurations. More specifically, the present invention is an inflatable mannequin for resembling a shape of an upper half of a body. The inflatable mannequin is formed by preparing an airtight upper bag body portion formed by joining a plurality of sheets together, the sheets being made of an elastic material such as vinyl and polypropylene, and by inflating the upper bag body portion by filling with air. The invention is characterized in that a gusset is coupled through a curved junction line with a sheet forming a base part of the upper bag body portion.

The invention is also an inflatable mannequin for resembling a shape of a lower half of a body. The inflatable mannequin is formed by preparing an airtight lower bag body portion formed by joining a plurality of sheets together, the sheets being made of an elastic material such as vinyl and polypropylene, and by inflating the lower bag body portion by filling with air. The invention is characterized in that a gusset is coupled through a curved junction line with a sheet forming a base part of the lower bag body portion.

The present invention is an inflatable mannequin for resembling shapes of upper and lower halves of a body. The inflatable mannequin is formed by preparing an airtight bag body formed by joining a plurality of sheets together, the sheet being made of an elastic material such as vinyl and polypropylene, and by inflating the bag body by filling with air. The invention is characterized in that upper and lower bag body portions resembling the upper and lower halves of the body, respectively, are separately provided to form the bag body. The invention is also characterized in that gussets are coupled through curved junction lines with sheets forming base parts of the upper and lower bag body portions, respectively.

According to these inventions, the gussets are coupled through the junction lines with the sheets forming the base parts of the upper and lower bag body portions, respectively. Accordingly, the obtained inflatable mannequin inflated by being filled with air is capable of resembling a stereoscopic and naturally undulating line of a body shape. When dressed in clothes, the inflatable mannequin enhances the appearance of the marketability, thereby maintaining brand image.

In the inflatable mannequin of the above-described invention, the invention is characterized in that the respective midriff portions of the upper and lower bag body portions are coupled with each other to form the mannequin.

According to the present invention, the upper and lower bag body portions as parts of the mannequin are separately provided. Therefore, the obtained mannequin is capable of imitating the appearance of a stereoscopic and natural body shape at both the upper and lower halves.

In the inflatable mannequin of the above-described invention, the invention is characterized in that the gusset is formed as a strip-shaped chest gusset with a predetermined width, and is placed so as to vertically pass at least the top parts of the chest of the upper bag body portion.

The provision of the chest gusset effectively emphasizes the prominences of the chest while preventing the chest, namely right and left nipples from expanding outward. Accordingly, the obtained mannequin is capable of expressing natural feminine characteristics.

In the inflatable mannequin of the above-described invention, the invention is characterized in that a chest interposition is provided inside the upper bag body portion in such a way that the chest interposition is placed between a center of a chest and a back of the body and extends in a vertical direction.

The presence of the chest interposition pulls the center of the chest inward. Accordingly, the obtained mannequin is capable of further suppressing the outward expansion of the right and left breasts in their respective directions, while realizing a deeply shaped pit of the stomach (cleavage) and a depression in the back of the body.

In the inflatable mannequin of the above-described invention, the invention is characterized in that the gusset is formed as a strip-shaped crotch-to-waist gusset with a predetermined width. The gusset is joined and placed in such a way that the gusset covers a crotch defined between right and left femoral regions and is inserted along a length from the crotch to a waist extending from a front side to a rear side in the lower bag body portion.

Accordingly, the crotch between the right and left femoral regions is allowed to have a width. Accordingly, when dressed in underclothes or pants, the mannequin is capable of beautifully expressing the line below the crotch.

In the inflatable mannequin of the above-described invention, the invention is characterized in that a crotch-to-waist interposition is joined inside the lower bag body portion in such a way that the crotch-to-waist interposition is placed at least between the front side and the rear side of the length from the crotch to the waist.

The existence of the crotch-to-waist interposition provides an aesthetically pleasing outline of pants the mannequin is to wear without damaging the shape of the buttocks.

The present invention is a method of manufacturing the inflatable mannequin as recited in the above-described invention, characterized in that an airtight bag body for the mannequin is formed by joining a plurality of sheets together, the sheets being made of an elastic material such as vinyl and polypropylene using a joining jig.

The joining jig is used to form the mannequin. Accordingly, the gusset even of a curved shape can easily be joined.

In the method of manufacturing the inflatable mannequin of the above-described invention, the present invention is characterized in that the joining jig includes a gusset joining jig with a curved junction line used for joining the gusset, and an outer shape line defining jig with an outer shape line for defining the outer shape of the mannequin.

Use of the gusset joining jig and the outer shape line defining jig facilitates joining of sheets and formation of the mannequin.

In the method of manufacturing the inflatable mannequin of the above-described invention, the invention is characterized in that the gusset joining jig and the outer shape line defining jig are provided with cutters on their respective sides with which the sheets are to be joined.

A redundant portion is cut off by the cutters when the sheets are joined by high-frequency gluing, heat fusing, and the like. Therefore, the mannequin is formed efficiently.

Advantageous Effects of Invention

The present invention is capable of producing a mannequin the outer appearance of which is close to a human body. Accordingly, when dressed in clothes, the mannequin is capable of enhancing the appeal of marketability of the clothes. Further, the mannequin is made of an elastic material sheet, and is considerably lighter in weight and softer than a mannequin formed from a conventional molded article. This allows use of the ceiling, walls and the like of a store as display space that cannot be used for store display. Further, the mannequin of the invention, less expensive than the molded mannequin, advantageously reduces costs such as delivery costs and inventory-carrying costs.

BEST MODE FOR CARRYING OUT INVENTION

Figure 1:
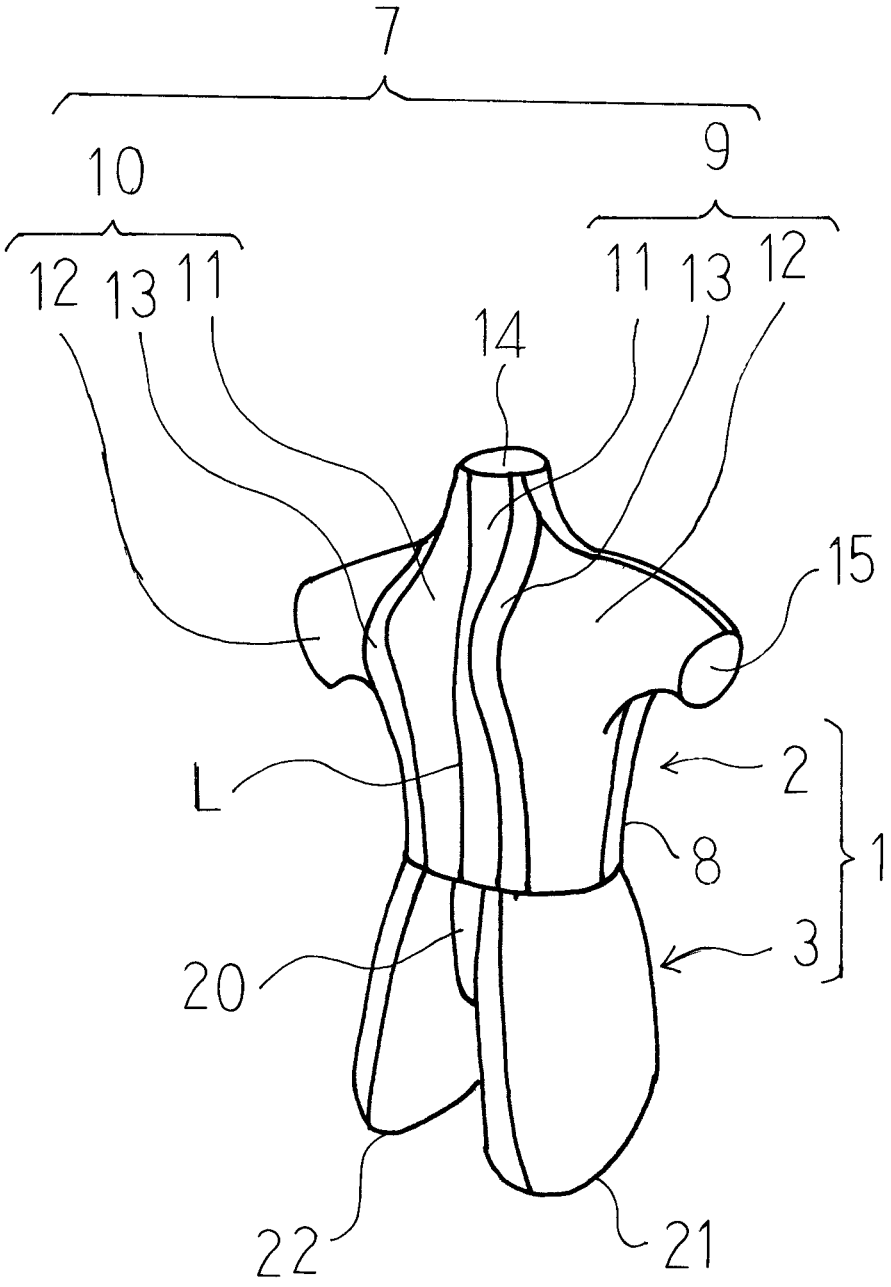
FIG. 1 is a perspective view illustrating the outer appearance of an inflatable mannequin in finished form according to an embodiment.
Figure 2A:
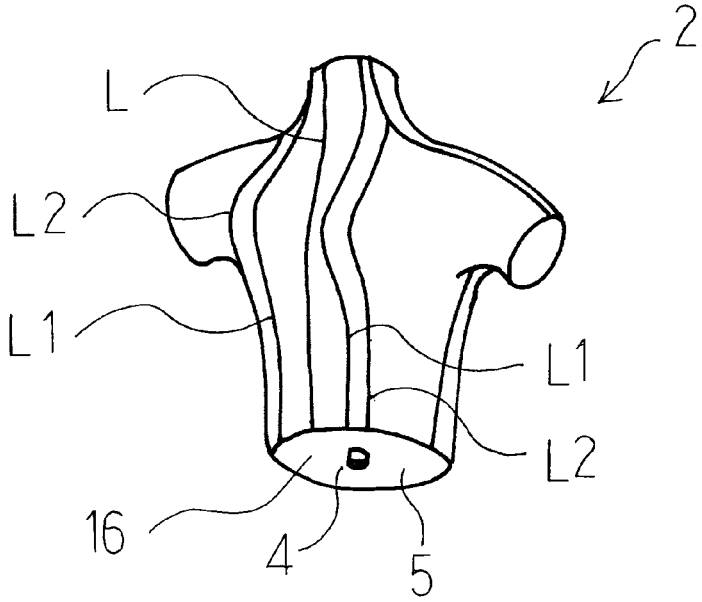
FIG. 2 relates to an upper bag body portion of the above embodiment, FIG. 2(*a*) being a perspective view illustrating the outer appearance of the upper bag body portion, FIG. 2(*b*) being a sectional perspective view of the upper bag body portion when viewed from the side, and FIG. 2(*c*) being a sectional view taken along a line A-A in FIG. 2(*b*).
Figure 2B:
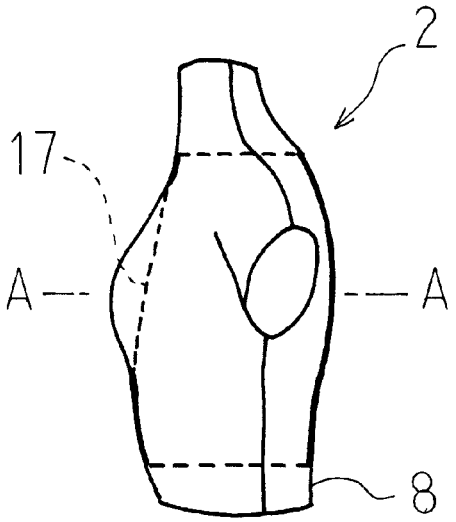
Figure 2C:
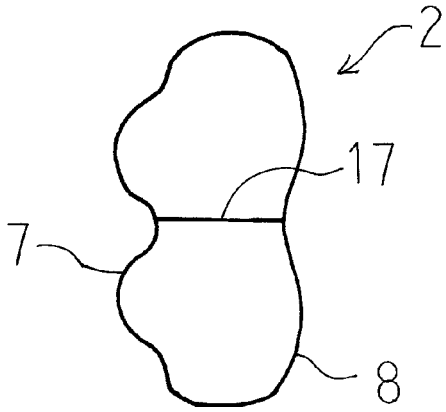
Figure 3A:
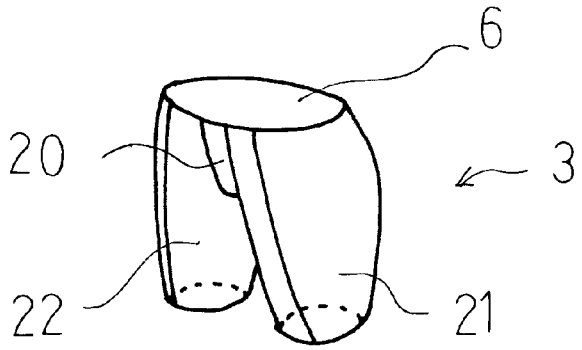
FIG. 3 relates to a lower bag body portion of the above embodiment, FIG. 3(*a*) being a sectional view illustrating the outer appearance of the lower bag body portion when viewed diagonally from the front, FIG. 3(*b*) being a perspective view illustrating the outer appearance of the lower bag body portion when viewed diagonally from the back, and FIG. 3(*c*) being a sectional perspective view illustrating the lower bag body portion when viewed from the side.
Figure 3B:
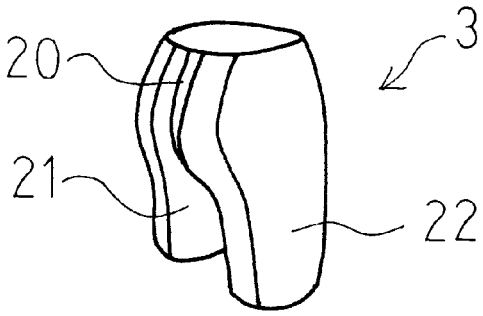
Figure 3C:
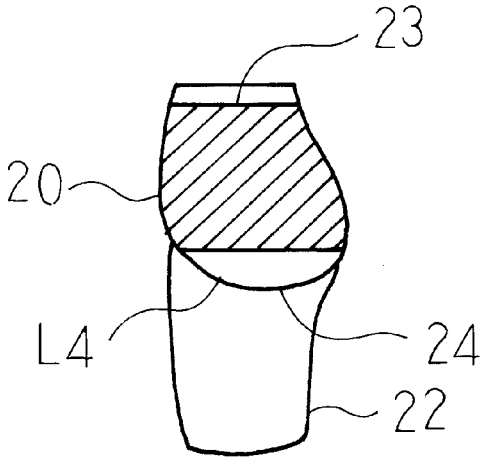

Next, an embodiment of an inflatable mannequin according to the invention is described in detail with reference to FIG. 1 to FIG. 3. FIG. 1 is a perspective view illustrating the outer appearance of an inflatable mannequin 1 (hereinafter also called "mannequin" simply) in finished form. FIG. 2 relates to an upper bag body portion 2 resembling the shape of the upper half of a body. FIG. 2(*a*) is a perspective view illustrating the outer appearance of the upper bag body portion 2. FIG. 2(*b*) is a sectional perspective view of the upper bag body portion 2 when viewed from the side. FIG. 2(*c*) is a sectional view taken along a line A-A in FIG. 2(*b*). FIG. 3 relates to a lower bag body portion 3. FIG. 3(*a*) is a perspective view illustrating the outer appearance of the lower bag body portion 3 when viewed diagonally from the front. FIG. 3(*b*) is a perspective view illustrating the outer appearance of the lower bag body portion 3 when viewed diagonally from the back. FIG. 3(*c*) is a sectional perspective view illustrating the lower bag body portion 3 when viewed from the side. In the present embodiment, the mannequin 1 is applied, for example, as a women's mannequin.

An elastic material such as vinyl and polypropylene is employed as a material for the inflatable mannequin 1. A plurality of cut sheets to serve as parts of the upper and lower halves of the body are joined (hereinafter also called "bonded") by high-frequency gluing means, thereby forming an airtight bag body serving as the inflatable mannequin 1. The upper bag body portion 2 resembling the upper half of the body and the lower bag body portion 3 resembling the lower half of the body are provided separately to form this bag body. The upper and lower bag body portions 2 and 3 are inflated by being filled with air through respective air valves 4 (valve 4 of the lower bag body portion 3 is not shown). Then, a midriff portion of the upper bag body portion 2 and a midriff portion 6 of the lower bag body portion 3 are joined together into one by an appropriate adhesive or high-frequency gluing, thereby manufacturing the mannequin 1. The structure of the mannequin 1 will be described next in more detail, and a method of manufacturing the mannequin 1 will be described later.

The upper bag body portion 2 includes a front sheet 7 and a back sheet (rear sheet) 8. The front sheet 7 includes a left half sheet 9 and a right half sheet 10. The rear back sheet 8 is formed from a single sheet. The left and right half sheets 9 and 10 are formed into bilaterally symmetric shape. The left and right half sheets 9 and 10 each have parts sheets including an inner sheet 11 placed close the center of a chest, an outer sheet 12 placed outside of the chest, and a strip-shaped gusset (hereinafter also called "chest gusset") 13 with a predetermined width placed between the inner and outer sheets (called "base part") 11 and 12. These sheets 11, 12 and 13 are joined together to form the respective sheets 9 and 10. The half sheets 9 and 10 are joined together at a chest centerline L to form the front sheet 7. The gussets 13 are placed so as to vertically pass the top parts of the chest (breasts), and are intended to provide well-shaped prominences of the chest.

A chest interposition 17 is joined inside the upper bag body portion 2. As shown in FIGS. 2(*b*) and 2(*c*), the sheet-like chest interposition 17 is placed between the center of the chest and the back of the body, while extending along the chest centerline L, namely in a vertical direction.

The front sheet 7 is joined with the back sheet 8 to define the outer shape of the mannequin 1. A junction line is cut at a neck portion, a shoulder tip and the midriff portion with which cover sheets 14, 15 and 16 are to be joined respectively by ring installation described later. A bag body as the upper bag body portion 2 maintaining airtightness is thereby formed.

After the upper bag body portion 2 is inflated by being filled with air, as shown in FIG. 2, junction lines L1 and junctions lines L2 are vertically defined between the inner sheets 11 and the gussets 13 between the outer sheets 12 and the gussets 13, respectively.

The presence of the gussets 13 realizes voluminous look of the chest circumference, so that feminine characteristics can be expressed. At the time of filling with air, the presence of the chest interposition 17 causes the chest centerline L and the back of the body to pull each other through the chest interposition 17. Accordingly, as a result of synergic effect obtained by the combination with the gussets 13, outward expansion of the top parts of the chest is suppressed while a deeply shaped cleavage (pit of the stomach) is realized. Besides, a depression at which the back of the body is to be located is formed at the central part of the back sheet 8. Thus, the upper bag body portion 2 is allowed to imitate the upper half of the body emphasizing a women's natural and good-looking chest.

Like the upper bag body portion 2, the lower bag body portion 3 is shaped by high-frequency gluing means as an airtight bag body. A crotch-to-waist gusset and a crotch-to-waist interposition that are characteristic features of the present invention are joined with the lower bag body portion 3. More specifically, as shown in FIG. 3, a strip-shaped crotch-to-waist gusset 20 with a predetermined width is provided along the length from the crotch to the waist defined between left and right femoral region sheets 21 and 22 that form the base part of the lower bag body portion 3. In other words, the crotch-to-waist gusset 20 is inserted in a substantially U-shape along the crotch extending from the foreside (front side) to the rear side (backside). The left and right femoral region sheets 21 and 22 are joined along a junction line L4 with opposite sides of the crotch-to-waist gusset 20. The provision of the crotch-to-waist gusset 20 defines sufficient space at the crotch between the left and right femoral region sheets 21 and 22 of the lower bag body portion 3 when the lower back portion 3 is inflated by being filled with air.

As shown by the hatching in FIG. 3(*c*), a sheet-like crotch-to-waist interposition 23 is joined inside the lower bag body portion 3 in such a way that it extends at least between the front side and the rear side of the length from the crotch to the waist. This causes the foreside and the backside of the length from the crotch to the waist to pull each other through the crotch-to-waist interposition 23, so that right and left buttocks can be definitely shaped in cooperation with the existence of the crotch-to-waist gusset 20, as shown in FIG. 3(*b*). The lower edge of the crotch-to-waist interposition 23 may be U-shaped so that it may be joined with the crotch's R-shaped portions 24 of the crotch-to-waist gusset 20.

The crotch-to-waist gusset 20 and the crotch-to-waist interposition 23 are joined with the left and right femoral region sheets 21 and 22, and cover sheets are respectively joined by ring installation with exposed areas of the midriff portion 6 and leg portions 25. As a result, the lower bag body portion 3 is formed as a bag body maintaining airtightness. Then, the lower bag body portion 3 of the mannequin 1 is inflated by being filled with air to resemble a line of a body shape.

The above-described upper and lower bag body portions 2 and 3 resembling a line of a body shape separately, are joined with each other at the midriff portions 5 and 6, so that the mannequin 1 shown in FIG. 1 is completed.

Next, a method of manufacturing the inflatable mannequin 1 that is another technical feature of the present invention is described with reference to FIGS. 4 to 14. Hereinafter, a description will be given of the formation of the upper bag body portion 2. The mannequin 1 is formed by joining sheets by using a gusset joining jig (hereinafter also called "jig" or "mold" depending on the situation) 30 shown in FIG. 4(*a*), and outer shape line defining jigs (hereinafter also called "jigs" or "molds" depending on the situation) 41 and 42 shown in FIG. 12(*a*), each having an outer shape line for defining the outer shape of the mannequin 1. The jigs 30, 41 and 42 are constituent elements of the high-frequency gluing means.

Figure 5B:
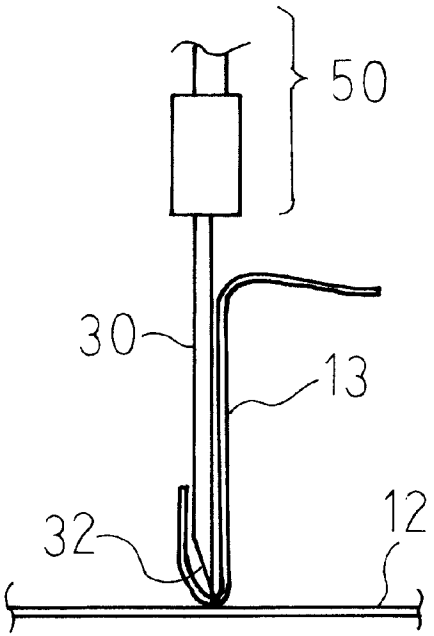
FIG. 5(*a*) is an explanatory view of an outer appearance, illustrating how a chest gusset is joined with an outer sheet and FIG. 5(*b*) is an enlarged sectional view taken along arrow A1-A1 in FIG. 5(*a*).
Figure 5A:
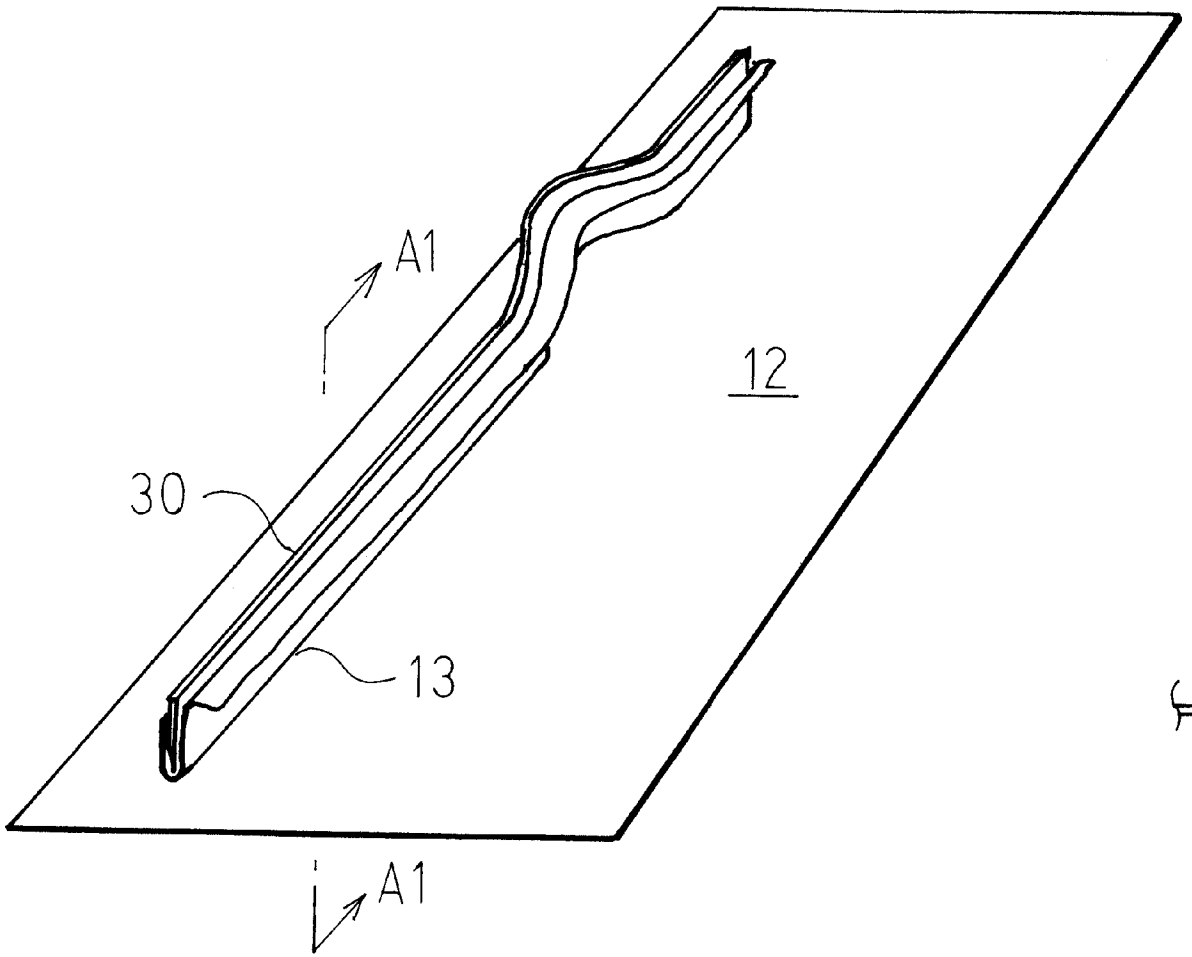

The jigs 30, 41 and 42 are each incorporated to a high-frequency gluing device 50 (see FIG. 5(*b*)). Here, materials are joined together at the molecular level by using a high-frequency gluing device. Other publicly known joining techniques of various types such as those used in ultrasonic welding devices using ultrasonic waves, heat fusing devices using electric heating and the like may be employed.

The gusset joining jig 30 as a joining jig, namely as a mold is a metal jig in the form of a plate having an excellent heat conductivity. The gusset joining jig 30 has a curved portion 31 formed at its midway point for defining a curved junction line corresponding to the prominences of the chest. A cutter portion 32 extending through most of the length of the jig 30 is provided to a junction side. As a result of pressing with the jig 30 from above and fusing (joining), overlaid sheets are joined (welded or fused). At the same time, unnecessary portions of the sheets are easily removed by pulling these portions by hand.

The jig 41 is intended to define a shoulder portion extending from the neck to the arms. The jig 42 is intended to define the outer shape of the flanks Like the jig 30, cutter portions 43 and 44 extend through most of the respective lengths of the jigs 41 and 42. In the present embodiment, an outer shape line defining jig includes the two members 41 and 42. The members 41 and 42 may alternatively be formed in one piece.

As described, members including the jigs 30, 41 and 42 each have a welding press function and a cutting function.

(Joining of Right and Left Half Sheets)

Figure 4A:
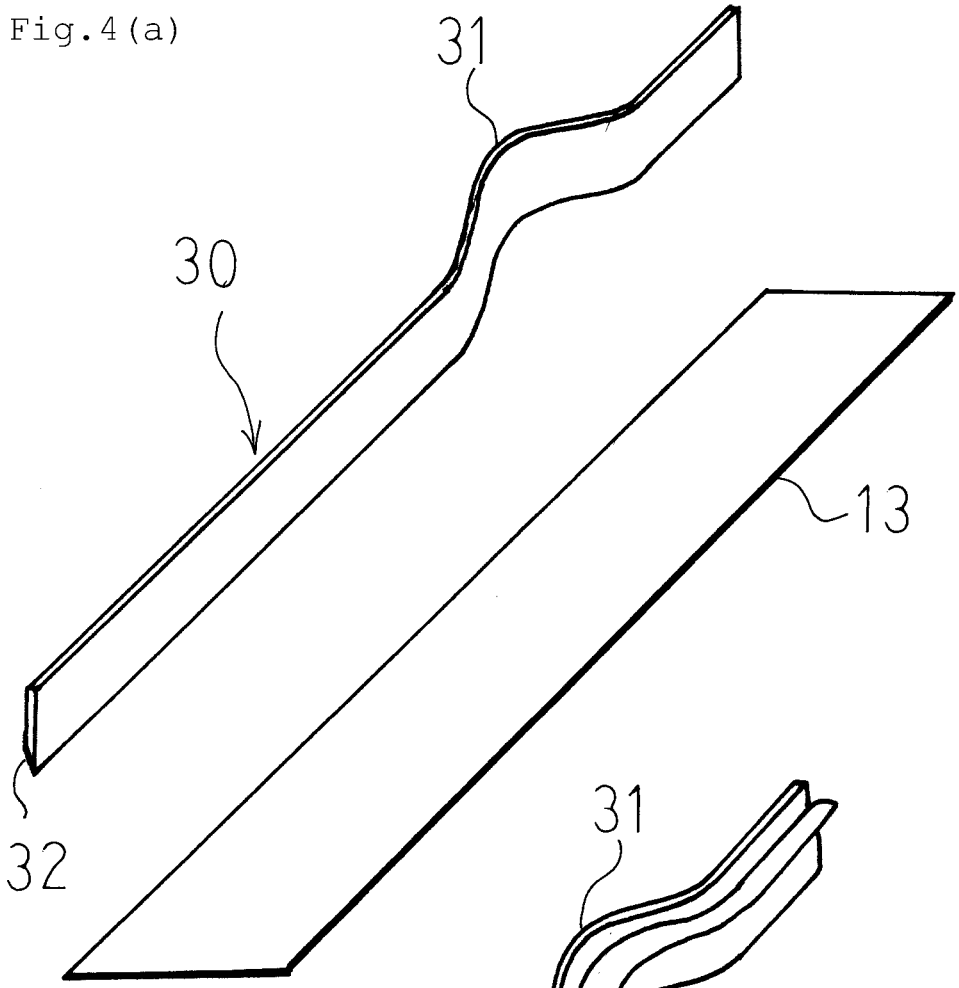
FIG. 4 is an explanatory view illustrating an outer appearance explaining the relationship between a jig and a sheet in a method of manufacturing the above mannequin.
Figure 4B:
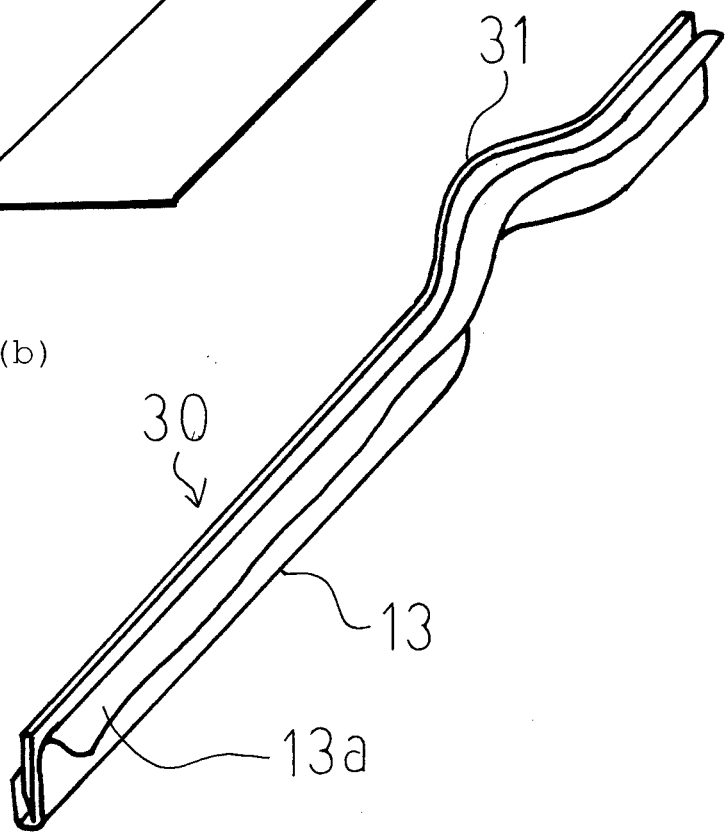

Formation of the left half sheet 9 shown in FIG. 1 includes, as preparation, cutting to obtain a sheet of a predetermined size to serve as the chest gusset 13 as shown in FIG. 4(*a*). Next, as shown in FIG. 4(*b*), the gusset 13 is placed along the cutter portion 32 of the jig 30. Then, a redundant portion 13*a* is temporarily fixed with clips and the like not shown so that the redundant portion 13*a* may not overhang an edge opposite to the cutter portion 31. By doing so, the upper edge surface of the jig 30 opposite to the cutter portion 31 is exposed, so that it can be pressed with the high-frequency gluing device 50 in metallic contact therewith.

Figure 6A:
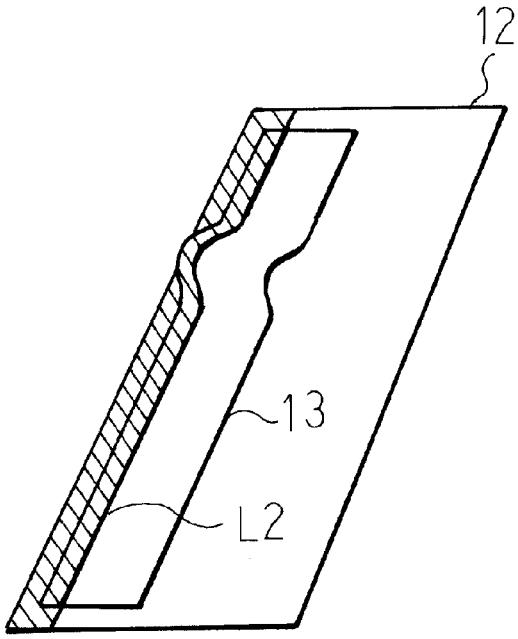
FIG. 6 is also an explanatory view illustrating how a redundant sheet is cut off after the chest gusset is joined with the outer sheet.
Figure 6B:
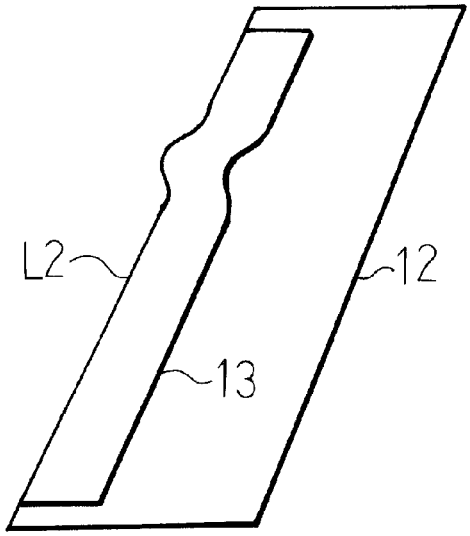

As shown in FIG. 5(*b*), the gusset 13 integrated with the jig 30 is placed on the outer sheet 12 spread on a plate table (not shown). Next, the high-frequency gluing device 50 is pushed against the upper edge surface of the jig 30. As a result, the gusset 13 is joined in one piece with the outer sheet 12, and at the same time, a hatched redundant area is automatically cut off by the cutter portion 32. Then, as shown in FIG. 6(*b*), the outer sheet 12 is joined through the junction line L2.

Figure 7A:
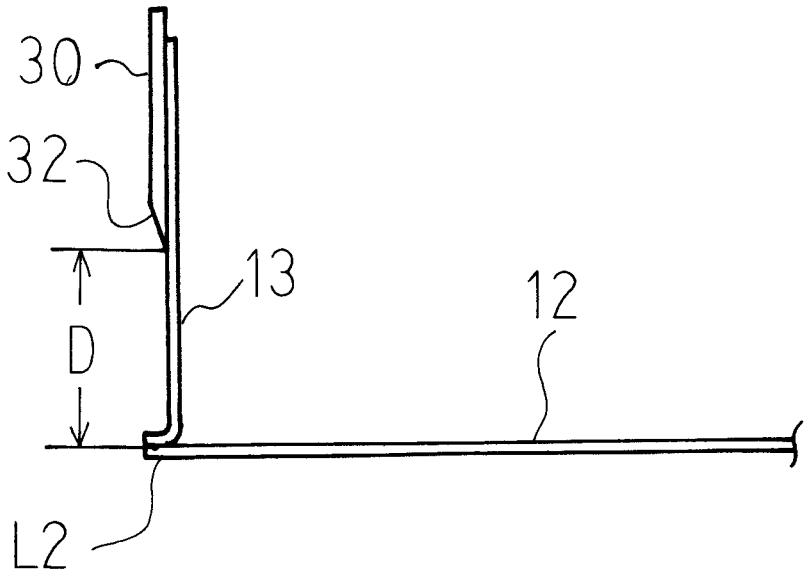
FIG. 7 is also an explanatory view illustrating how an inner sheet is joined with the chest gusset.
Figure 7B:
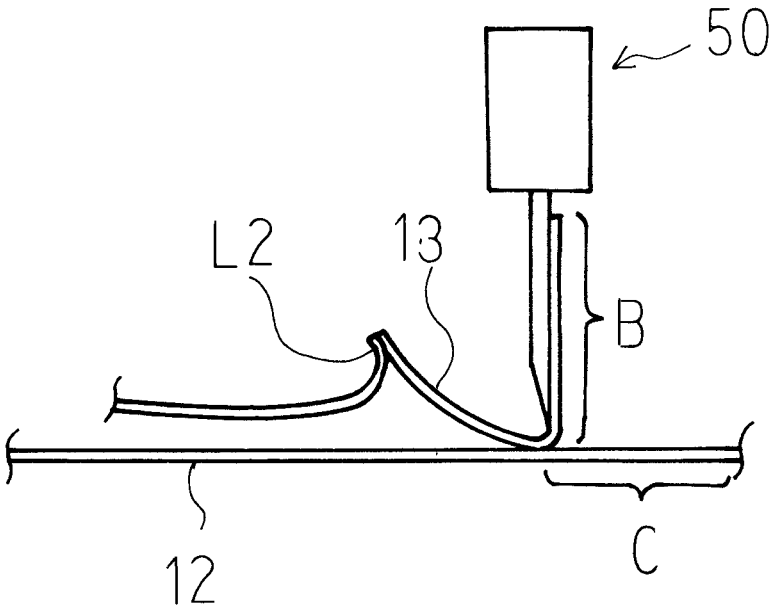

Likewise, as shown in FIG. 7(*b*), the jig 30 is placed along the gusset 13 in such a way that the cutter portion 32 of the jig 30 is located at a position away from the junction line L2 by a predetermined width size D. Then, with the gusset 13 integrated with the outer sheet 12 turned outside down, as shown in FIG. 7(*b*), a redundant portion B of the gusset 13 is temporarily fixed at appropriate intervals with clips and the like, not shown, in the lengthwise direction of the jig 30 so that it may not project outward from the upper edge surface of the jig 30. The gusset 13 is thereafter placed on the inner sheet 11. In this state, the upper edge surface of the jig 30 is pressed with the high-frequency gluing device 50 in metallic contact therewith. As a result, the redundant portion B of the gusset 13 and a redundant portion C of the inner sheet 11 are simultaneously cut off, and at the same time, the gusset 13 is integrated with the inner sheet 11 through the junction line L1.

Figure 8A:
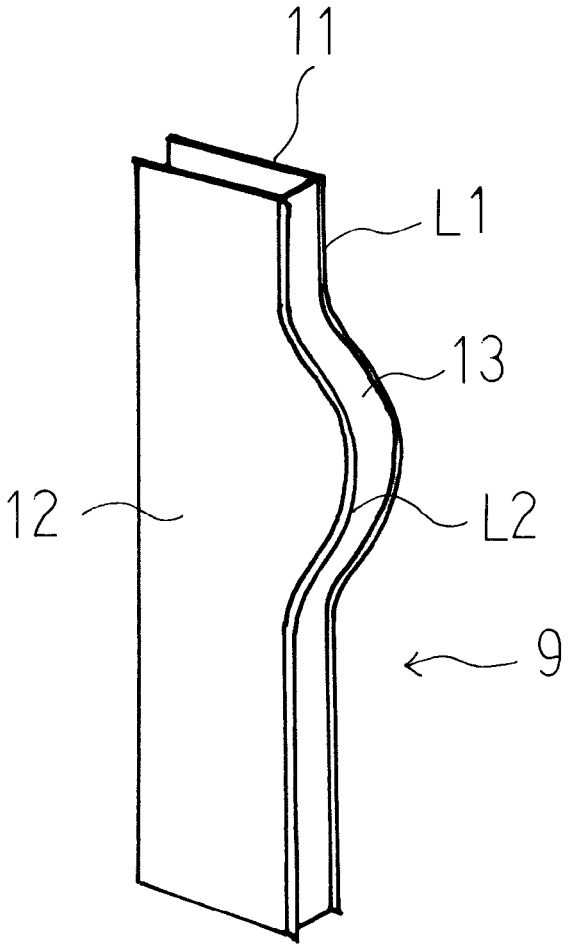
FIG. 8 also shows a left front sheet formed after joining of the chest gusset, FIG. 8(*a*) being a perspective view illustrating the outer appearance of the left front sheet before turned inside out, and FIG. 8(*b*) being a perspective view illustrating the outer appearance of the left front sheet after turned inside out.
Figure 8B:
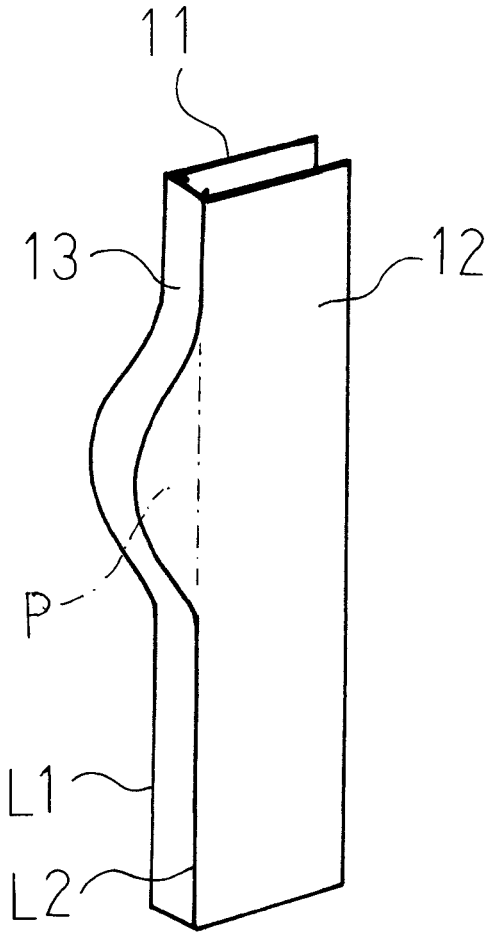

By doing so, as shown in FIG. 8(*a*), the inner and outer sheets 11 and 12 are integrated through the junction lines L1 and L2 respectively at opposite side edges of the gusset 13, thereby forming the left half sheet 9 having a square-cornered U shape in cross section. The left half sheet 9 thereby formed is turned inside out to obtain the left half sheet 9 shown in FIG. 8(*b*). With respect to the planes of the inner and outer sheets 11 and 12, the junction lines L1 and L2 are curved in the direction of these planes. With respect to the gusset 13, the junction lines L1 and L2 serve to bend the gusset 13 itself in a direction in which the body goes forward. The inner and outer sheets 11 and 12 expand outward in their directions in the case of future inflation. At this time, the existence of the curved junction lines L1 and L2 defines respective residual curved portions P of the inner and outer sheets 11 and 12 at the chest at which the gusset 13 is placed. Accordingly, the prominence of the chest can beautifully be expressed.

Following the same process steps as those for forming the above-described left half sheet 9, the right half sheet 10 can be formed to be bilaterally symmetric with the left half sheet 9.

(Joining of Front Sheet)

Figure 9A:
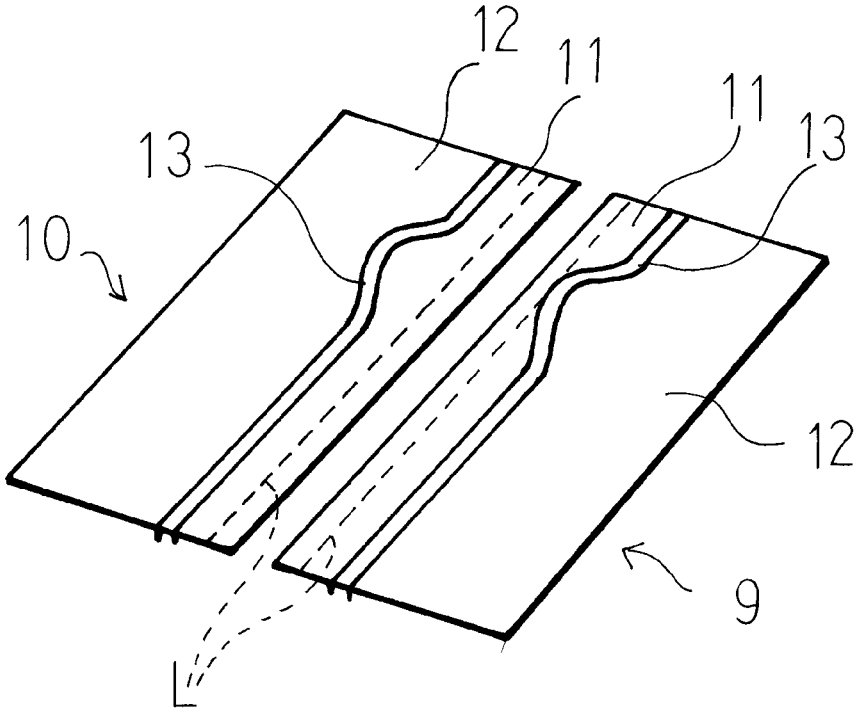
FIG. 9 is also an explanatory view illustrating how right and left front sheets are joined into one.
Figure 9B:
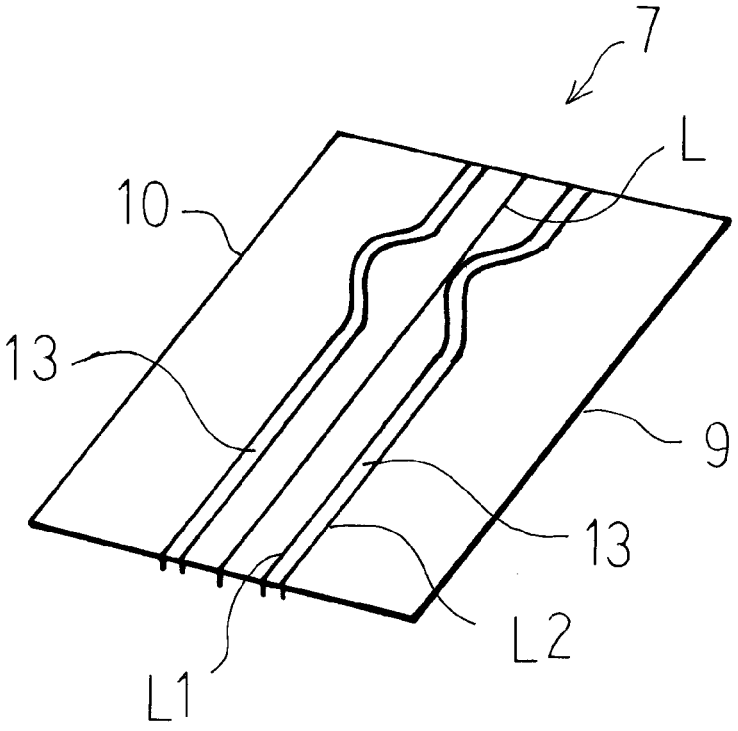

The left and right half sheets 9 and 10 are expanded and then spread so that only the chest will swell out as shown in FIG. 9(*a*). Then, the sheets 9 and 10 are joined together with the respective chest centerlines L indicated by dashed lines in the respective inner sheets 11 of the sheets 9 and 10 aligned with each other. This joining uses a linear jig not shown in the drawings. As a result, the left and right half sheets 9 and 10 are joined with each other to form the front sheet 7 as shown in FIG. 9(*b*).

(Formation and Joining of Interposition)

Figure 10A:
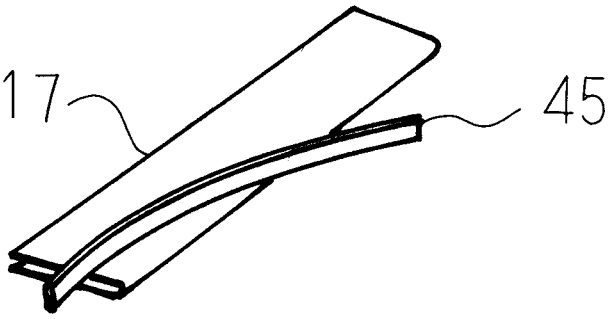
FIG. 10 is also an explanatory view illustrating how a chest interposition is formed.
Figure 10B:
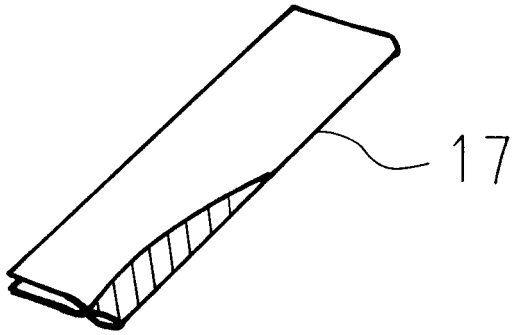
Figure 10C:
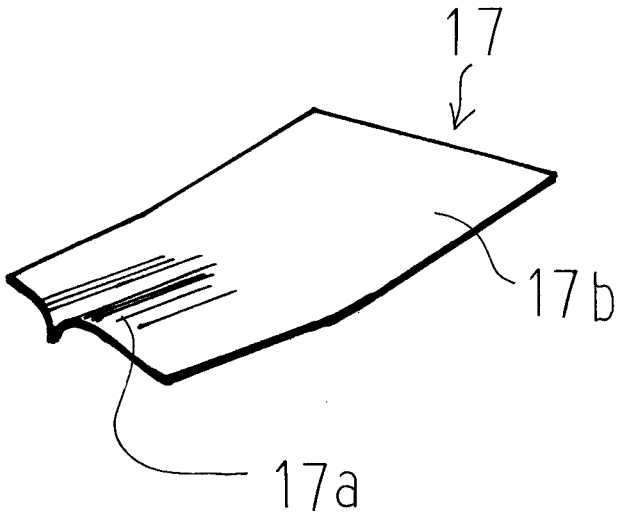

As shown in FIG. 10(*a*), a single sheet 17 is folded into two, and a curved jig 45 is applied from above to one of the two. Next, the above-described process using the high-frequency gluing device 50 is also performed to join the two in such a way that parts of the two near a crease are picked together as shown in FIG. 10(*b*), and a hatched area is cut off. The resultant sheet 17 is expanded to obtain the chest interposition 17 as shown in FIG. 10(*c*). A joined and clipped portion 17*a* of the interposition 17 is shorter in width than a not-clipped portion 17*b* thereof. The interposition 17 is formed with due considerations so that the clipped portion 17*a* will be placed at a neck portion, and the not-clipped portion 17*b* will be placed at the midriff portion.

Figure 11:
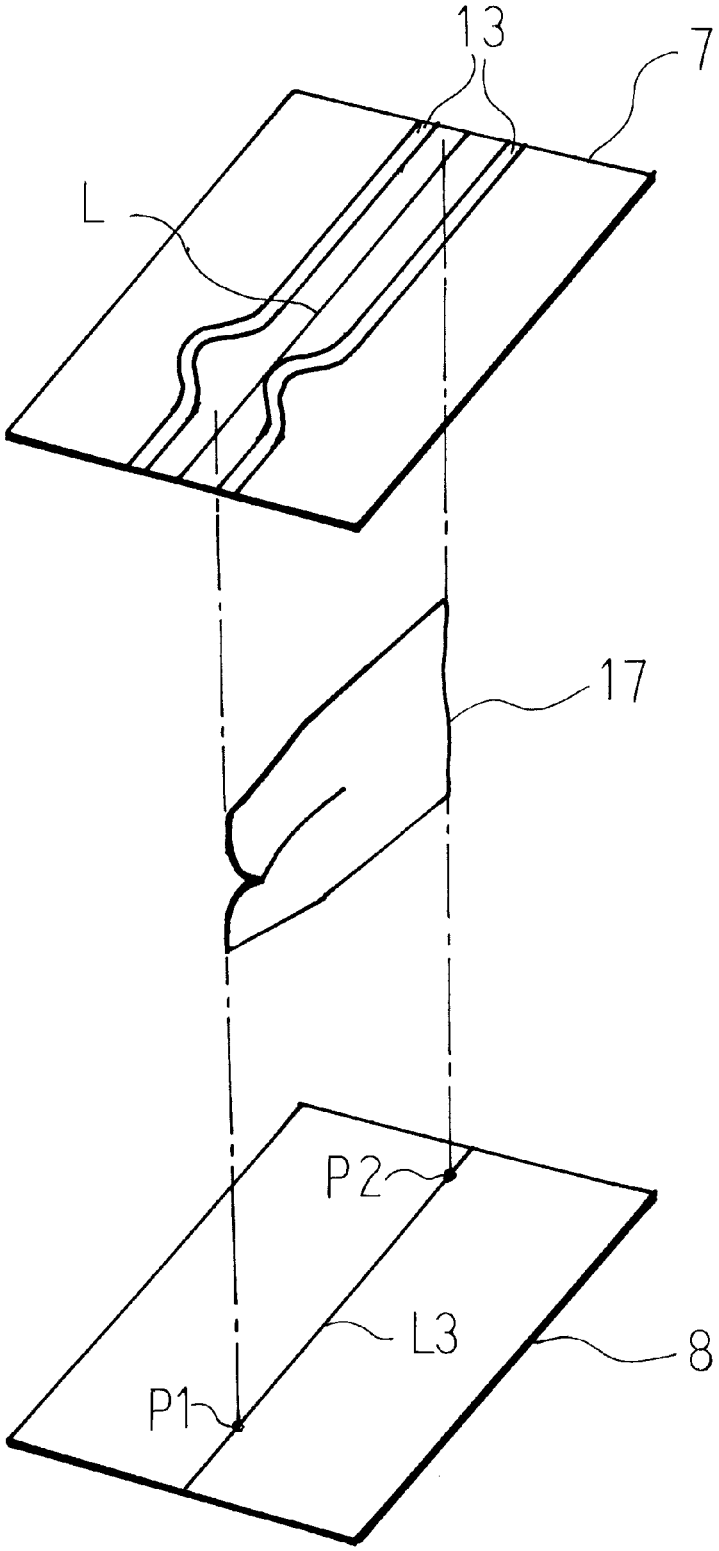
FIG. 11 is also an explanatory view illustrating how the chest interposition is joined with front and back sheets.

Next, as seen from an exploded view of FIG. 11, the high-frequency gluing device 50 with an appropriate jig is used to join one side edge of the interposition 17 with the chest centerline L of the front sheet 7, and to join the opposite side edge of the interposition 17 with a centerline L3 of the back sheet 8 corresponding to the back of the body. As a result, the chest interposition 17 is joined along a length between points P1 and P2.

(Definition of Outer Shape Line of Upper Bag Body Portion)

Figure 12A:
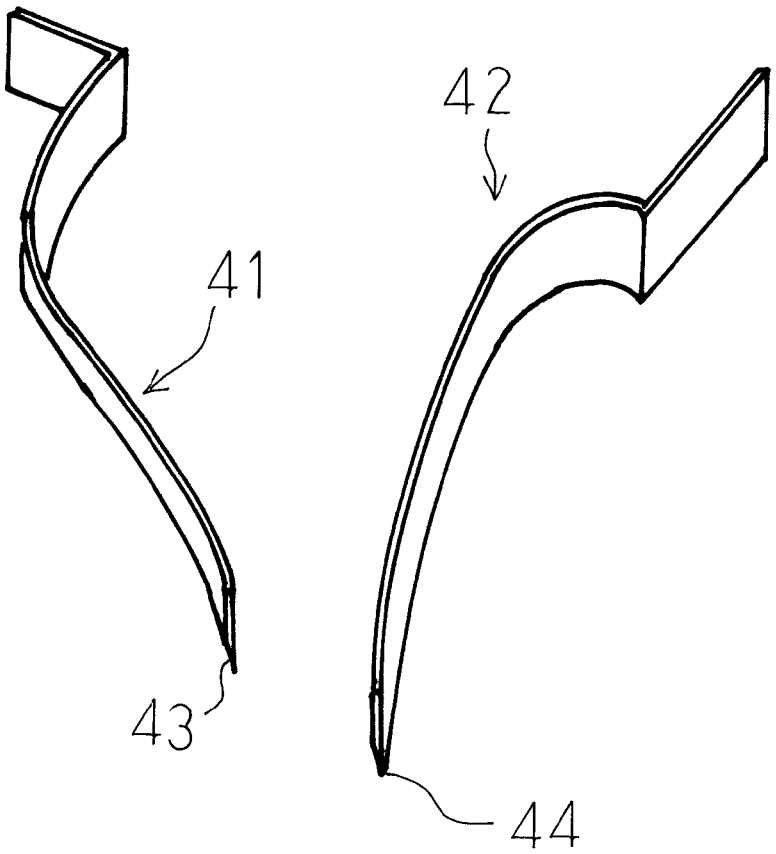
FIG. 12(*a*) is a diagram illustrating the outer appearance of an outer shape line defining jig, and FIG. 12(*b*) is a diagram illustrating the outer appearance where this jig is to be used.
Figure 12B:
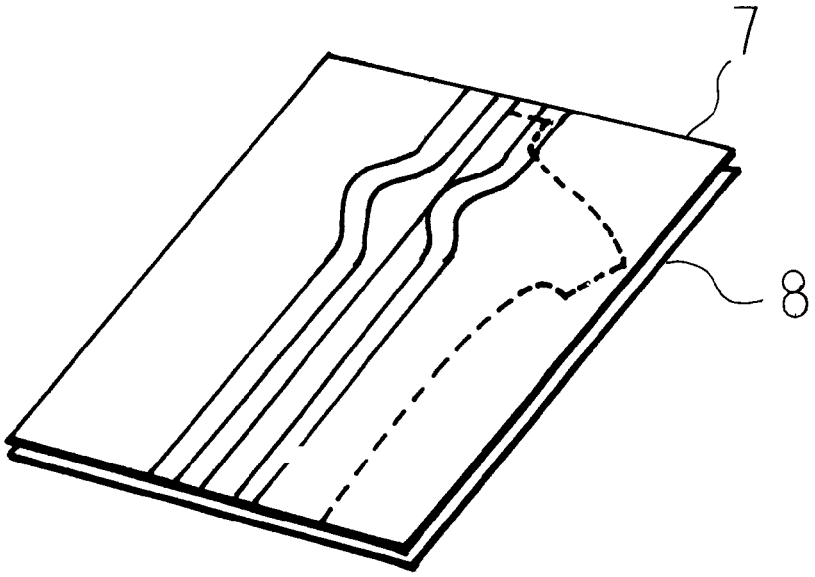
Figure 13:
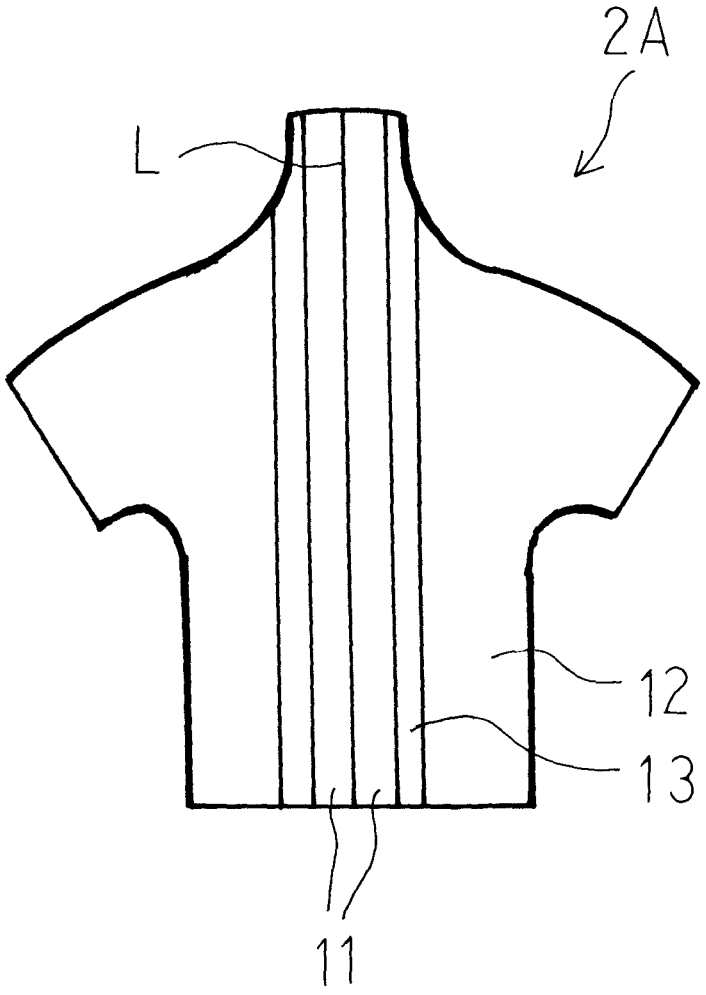
FIG. 13 is also a plan view illustrating a provisional upper bag body portion formed by using the outer shape line defining jig.

As shown in FIG. 12(*a*), the integrated front and back sheets 7 and 8 with the interposition 17 are aligned one above the other so that the respective centerlines L and L3 will coincide. In this state, the outer shape line defining jigs 41 and 42 shown in FIG. 12(*a*) are applied to be placed in positions indicated by dashed lines in FIG. 12(*b*). Then, joining and cutting are simultaneously performed using the high-frequency gluing device 50. Next, cutter means such as scissors is used to appropriately cut a junction line especially at the neck portion, the shoulder tip and the midriff portion to expose these portions as shown in FIG. 13. As a result, the junction line defined by welding remains in the other portions, thereby forming a provisional upper bag body portion 2A of the mannequin 1 with a shape of the upper half of the body.

(Ring Installation)

Figure 14A:
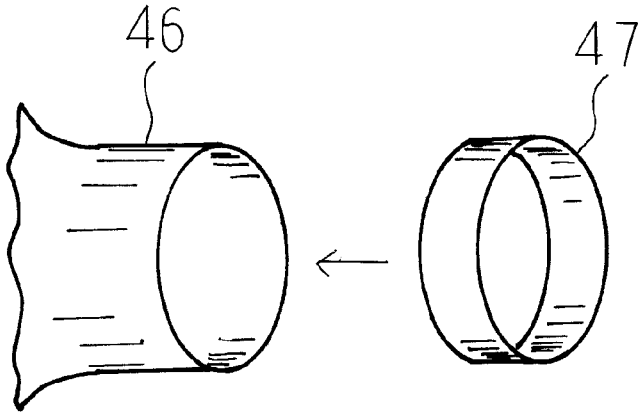
FIG. 14 is also an explanatory view explaining ring installation.
Figure 14B:
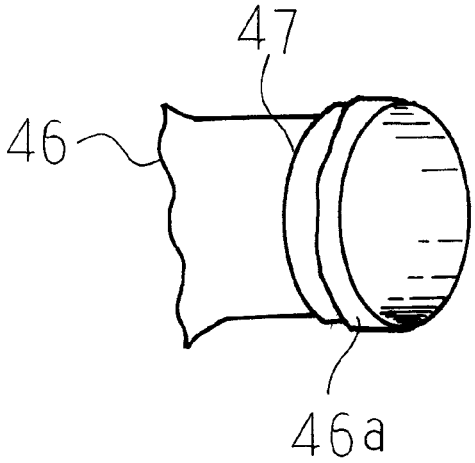
Figure 14C:
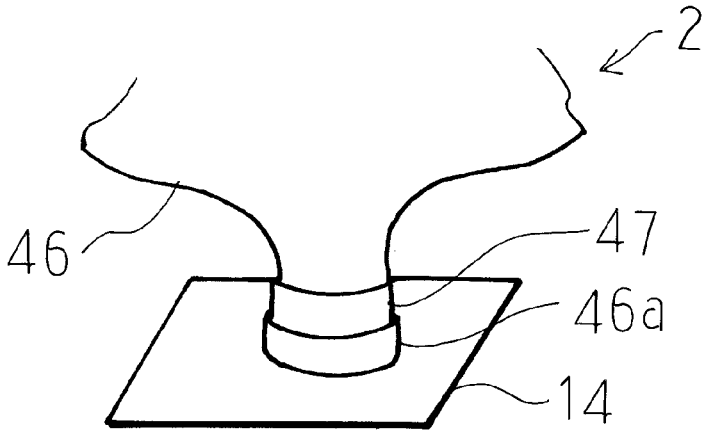
Figure 15:
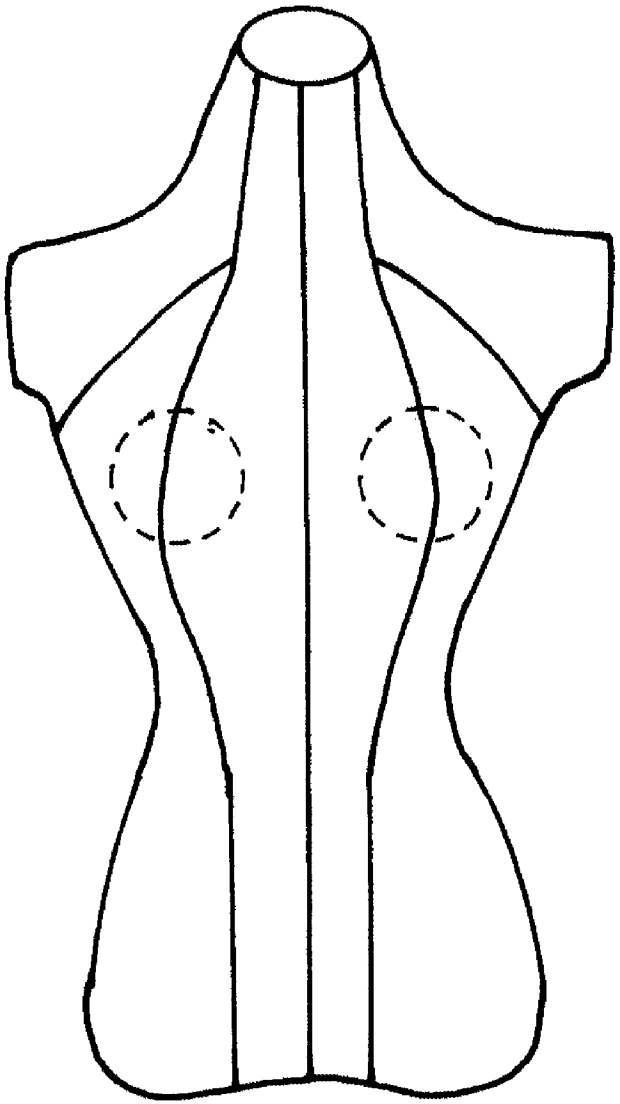
Prior Art Fig. 15
FIG. 15 shows a conventional technique.

The above-described neck portion, the shoulder tip and the midriff portion are exposed, so they should be joined with and covered by the cover sheets 14, 15 and 16 (see FIGS. 1 and 2) respectively by ring installation. The detail of the ring installation process is as follows. More specifically, in order to cover a neck portion 46 of the upper bag body portion 2 as shown in FIG. 14, a circular ring (jig) 47 of a dimension substantially commensurate with the exposed area of the neck portion is prepared as shown in FIG. 14(*a*). Next, as shown in FIG. 14(*b*), the ring 47 is fitted onto the corresponding neck portion 46, and then the edge of the neck portion 46 is folded back outward. Then, the neck portion 46 is placed on the cover sheet 14 as shown in FIG. 14(*c*), and is pressed while contact between the ring 47 and the high-frequency gluing device 50 (see FIG. 5(*b*)) is maintained. As a result, the cover sheet 14 is joined with the neck portion 46.

The cover sheets 15 and 16 are joined with the shoulder tip and the midriff portion by following the same process, respectively, thereby forming the airtight upper bag body portion 2 as a bag body.

The cover sheet 16 of the midriff portion is provided with the air valve 4 that is a one-way valve made of a synthetic resin. The air valve 4 is integrally attached to the cover sheet 16 by high-frequency gluing using a publicly known technique. Accordingly, the way of its attachment is not described here.

Then, the upper bag body portion 2 is formed as a bag body maintaining airtightness. Inflating the upper bag body portion 2 by filling with air through the air valve 4 forms the upper half of the mannequin 1 as shown in FIG. 2(*a*).

(Formation of Lower Bag Body Portion)

Like the upper bag body portion 2 described above, the lower bag body portion 3 is formed as an airtight bag body by using the high-frequency gluing device 50 with an appropriate jig. More specifically, the crotch-to-waist gusset 20 is inserted to form a substantially U-shape along the length from the crotch to the waist between the left and right femoral region sheets 21 and 22 forming the base part of the lower bag body portion 3, namely along the crotch extending from the foreside (front side) to the rear side (backside). The left and right femoral region sheets 21 and 22 are joined with the opposite side edges of the crotch-to-waist gusset 20. The surface of the crotch-to-waist gusset 20 itself is bent at right angles to have a U-shape, so that the crotch-to-waist gusset 20 is also joined with the left and right femoral region sheets 21 and 22 at curved junction lines.

As shown by the hatching in FIG. 3(*c*), the sheet-like crotch-to-waist interposition 23 is joined inside the lower bag body portion 3 in such a way that it extends at least between the front side and the rear side of the length from the crotch to the waist.

The above-described process of forming the upper bag body portion 2 is performed again to join the crotch-to-waist gusset 20 and the crotch-to-waist interposition 23 by using a gusset joining jig and an outer shape line defining jig of appropriate shapes not shown. As a result, the airtight lower bag body portion 3 is formed.

(Coupling of Upper and Lower Bag Body Portions)

The upper and lower bag body portions 2 and 3 resembling a line of a body shape separately, are coupled with each other at the respective midriff portions 5 and 6 in an inflated state by being filled with air. This coupling is realized by appropriate coupling means such as welding and adhesive bonding. As a result, the mannequin 1 as shown in FIG. 1 is obtained.

The inflatable mannequin 1 and the method of manufacturing the same of the present embodiment can easily provide the chest gusset 13 and the crotch-to-waist gusset 20 bent into predetermined shapes to the upper and lower bag body portions 2 and 3, respectively. This realizes a mannequin having a chest with prominent, and aesthetically pleasing breasts with a realistic pit of the stomach which closely resembles that of a human body and which prevents the right and left nipples from expanding outward, a depression in the back of the body, a crotch of a sufficient width, and a beautiful hipline. The inflatable mannequin 1 itself realizes a quite realistic body outline. Accordingly, when dressed in clothes and displayed, the mannequin 1 is capable of enhancing the appearance of the clothes as a commodity the mannequin 1 is wearing, thereby effectively avoiding a trouble of damaging brand image.

One embodiment of the inflatable mannequin and the method of manufacturing the same of the invention has been described in detail. The specific configurations of the inflatable mannequin and the manufacturing method are not limited to those of the present embodiment. Design variations and the like that do not go out of the gist of the present invention are also within the scope of the present invention.

More specifically, in the above-described embodiment, gussets are provided to a chest and to a length from a crotch to a waist. Naturally, a gusset may alternatively be provided to a buttock, or to other parts.

The mannequin 1 is intended for women. Naturally, the mannequin 1 may alternatively be applied to those for men, children, and the like.

The jigs 30, 41, 42 and 45 are provided with cutters, but may alternatively be of shapes without cutters. In this case, redundant and unnecessary sheets are cut off by scissors and the like at the time of joining of the sheets.

The front sheet 7 of the upper bag body portion 2 includes the outer and inner sheets 11 and 12, to which the number of sheets is not limited, of course. This is also applied to the lower bag body portion 3.

Bonding means such as a zipper and Magic Fastener (registered trademark) may be used to join the upper and lower bag body portions 2 and 3. In this configuration, the integrated upper and lower bag body portions 2 and 3 are separated, and are deflated by letting the internal air out. This reduces the volumes of the upper and lower bag body portions 2 and 3, thereby providing convenience in transportation.

INDUSTRIAL APPLICABILITY

The present invention is applicable to formation of an inflatable mannequin.

What is claimed is:

1. An inflatable mannequin for resembling a shape of an upper half of a body, comprising:

an airtight upper bag body portion formed by joining a plurality of sheets together, the sheets being made of an elastic material, the mannequin being formed by inflating the upper bag body portion by filling with air, wherein left and right halves of a base part of the upper bag body portion are joined by a chest center line, the left and right halves of the base part have two sheets and a chest gusset for joining the two sheets, respectively, one of the two sheets being an inner sheet, the inner sheet is placed closer to a center of the chest, and the other of the two sheets is an outer sheet, the outer sheet is placed closer to an outside of the chest, the outer sheet being formed to define from a shoulder portion to an outer shape of the flank, a first curved junction line coupling the inner sheet to the chest gusset and a second curved junction line coupling the outer sheet to the chest gusset, are substantially parallel to each other and vertically pass the sides of the nipples parts of the breast of the upper bag body portion, the first curved junction line and the second curved junction line extending from the shoulder portion to a waist portion, the chest gusset is formed as a strip-shape chest gusset between the first curved junction line and the second curved junction line with a predetermined width and is placed so as to being apart from a back sheet and vertically pass at least each of the nipples parts of the breast of the upper bag body portion, the first and second curved junction lines vertically extend from an upper portion of the chest to a lower portion of the chest, and the top parts of the chest of the upper bag body portion is placed between the first curved junction line and the second curved junction line.

2. An inflatable mannequin for resembling a shape of an upper half of a body, comprising:

an airtight upper bag body portion formed by joining a plurality of sheets together, the sheets being made of an elastic material, the mannequin being formed by inflating the upper bag body portion by filling with air, wherein upper and lower bag body portions resembling the upper and lower halves of the body, respectively, are separately provided to form the bag body, wherein left and right halves of a base part of the upper bag body portion are joined by a center line, the left and right halves of the base part have two sheets and a chest gusset for joining the two sheets, respectively, one of the two sheets being an inner sheet, the inner sheet is placed closer to a center of the chest, and the other of the two sheets is an outer sheet, the outer sheet is placed closer to an outside of the chest, the outer sheet being formed to define from a shoulder portion to an outer shape of the flank, a first curved junction line coupling the inner sheet to the chest gusset and a second curved junction line coupling the outer sheet to the chest gusset, are substantially parallel to each other and vertically pass the sides of the nipples parts of the breast of the upper bag body portion, the first curved junction line and the second curved junction line extending from the shoulder portion to a waist portion, the chest gusset is formed as a strip-shaped chest gusset between the first curved junction line and the second curved junction line with a predetermined width and is placed so as to being apart from a back sheet and vertically pass at least each of the nipples parts of the breast of the upper body bag portion, the first and second curved junction lines vertically extend from an upper portion of the chest to a lower portion of the chest, and the top parts of the chest of the upper bag body portion is placed between the first curved junction line and the second curved junction line.

3. The inflatable mannequin according to claim 2, wherein respective midriff portions of the upper and lower bag body portions are coupled with each other to form the mannequin.

4. The inflatable mannequin according to claim 1, wherein a chest interposition is provided inside the upper bag body portion in such a way that the chest interposition is placed between a center of a chest and a back of the body and extends in a vertical direction.

5. The inflatable mannequin according to claim 1, wherein a crotch-to-waist gusset is coupled to a base part of the upper bag body portion, the gusset is formed as a strip-shaped crotch-to-waist gusset with a predetermined width, and is joined and placed in such a way that the crotch-to-waist gusset passes a crotch defined between right and left femoral regions and is inserted along a length from the crotch to a waist extending from a front side to a rear side in a lower bag body portion.

6. The inflatable mannequin according to claim 1, wherein a crotch-to-waist interposition is joined inside the lower bag body portion in such a way that the crotch-to-waist interposition is placed at least between the front side and the rear side of the length from the crotch to the waist.

7. The inflatable mannequin according to claim 1 wherein the elastic material is vinyl or polypropylene.

8. The inflatable mannequin according to claim 2 wherein the elastic material is vinyl or polypropylene.

* * * * *